US007627971B2

(12) United States Patent
Fast

(10) Patent No.: US 7,627,971 B2
(45) Date of Patent: Dec. 8, 2009

(54) TAPELESS LABEL HOLDERS FOR FLAT FRONT FACE SHELVES

(75) Inventor: Jacob Fast, Boca Raton, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 228 days.

(21) Appl. No.: 11/409,049

(22) Filed: Apr. 24, 2006

(65) Prior Publication Data

US 2006/0254106 A1 Nov. 16, 2006

Related U.S. Application Data

(60) Provisional application No. 60/673,773, filed on Apr. 22, 2005.

(51) Int. Cl.
*G09F 3/18* (2006.01)

(52) U.S. Cl. ..... 40/661.03

(58) Field of Classification Search ..... 40/661.03
See application file for complete search history.

(56) References Cited

U.S. PATENT DOCUMENTS 5,394,632 A 3/1995 Gebka et al.
5,515,632 A 5/1996 Gebka et al.
5,899,011 A 5/1999 Brinkman
6,105,295 A * 8/2000 Brinkman et al. ..... 40/661.03
6,357,154 B1 * 3/2002 Pfendler et al. ..... 40/661.03
6,470,613 B1 * 10/2002 Wildrick ..... 40/661.03
6,568,112 B2 5/2003 Lowry et al.
D480,434 S 10/2003 Brinkman et al.
6,688,567 B2 * 2/2004 Fast et al. ..... 248/220.41
6,823,620 B2 * 11/2004 Nagel ..... 40/661.07
6,971,201 B2 * 12/2005 Brinkman et al. ..... 40/642.02
7,055,274 B2 * 6/2006 Fast et al. ..... 40/661.03
7,325,248 B2 * 1/2008 Syvanne ..... 726/11

* cited by examiner

*Primary Examiner*—Lesley D Morris
*Assistant Examiner*—Christopher E Veraa
(74) *Attorney, Agent, or Firm*—Jacobson Holman PLLC

(57) ABSTRACT

A label holder including a transparent cover member overlying a main body panel to form a label-receiving pocket connectable to a flat front face shelf without tape. The main body panel faces the front face of the shelf. The label holder includes an attachment structure for attaching the label holder to a horizontally oriented shelf lip by defining a U-shaped slot or gap. The attachment structure includes a concave portion, preferably U-shaped, that is elastically stretchable or deformable. This allows stretching of the attachment structure to accommodate different depths of the shelf lip.

6 Claims, 11 Drawing Sheets

TAPELESS LABEL HOLDERS FOR FLAT FRONT FACE SHELVES

This application claims the benefit of provisional application Ser. No. 60/673,773 filed Apr. 22, 2005.

BACKGROUND OF THE INVENTION

1. Field of the Invention

This invention relates to label holders for use with merchandise display shelves having a flat front face that is used in retail outlets such as department stores, supermarkets, drug stores, or the like, to receive labels providing information relating to merchandise being displayed on the shelves. More specifically, this invention is directed to a label holder with a transparent window or cover member hingedly and resiliently secured to a back or main body panel to form a pocket therebetween for reception of a paper label or the like. The label holder is intended for tape-free attachment to a shelf having a horizontally oriented merchandise support surface, a downwardly disposed flat face (i.e., without C-channel, for example) and an inwardly oriented lip parallel to the merchandise support surface.

2. Description of the Related Art

Consumer-oriented product information labels are commonly found in supermarkets, drug stores, and the like, and provide purchasers with the unit price, promotional and nutritional information, and the like and, also, commonly include bar codes or other inventory control information for the use of the store personnel. Such information may be carried on paper or plastic labels secured directly to the front edge of a merchandise shelf, but the use of adhesively-backed labels has obvious disadvantages in the constantly changing commercial environment found in today's marketplace. More often, plastic label holders are provided which are adapted to removably receive and display the labels in a well-known manner.

Such label holders are generally provided in elongated sections, perhaps four feet in length and may be secured by double-sided adhesive tape or the like to flat-faced supporting surfaces, such as the front edge of a merchandise shelf. This method of attaching is well known for merchandise shelves that do not have particular channels, such as C-channels, the latter of which are intended to receive the labels or plastic label holders as are known in the art.

Various label holders, as well as combined label and sign holders, are known in the art for connection with a wide variety of shelf configurations. A common label holder is one that includes a transparent window or cover member that is hingedly and resiliently secured to the lower edge of a back or main body panel to form a pocket therebetween for reception of a paper label or the like. See, for example, U.S. Pat. Nos. 5,394,632, 5,515,632 and 5,899,011, each of which disclose various label holders, including label holders where the cover member is locked to the back or main body panel. Combined label and sign holders are also well known in the art. See, for example, U.S. Pat. No. 6,568,112. Typically, the cover member of the label holder will include means for retaining a sign on the front face of the cover member, thus enabling the combined label and sign holder configuration.

As mentioned above, when the shelving to which a label holder is to be applied includes no front face gripping or attachment elements, such as a C-channel, to receive labels or label holders, the attachment of the label holder to the front face is typically by two-sided tape which has the disadvantages discussed above. Thus, a need has arisen for a label holder for tape-free connection with a flat face shelf arrangement. See, for example, U.S. Design Patent No. D480,434 and U.S. Pat. No. 6,971,201.

SUMMARY OF THE INVENTION

It is an object of the present invention to provide a novel label holder for facilitating attachment and detachment to a flat front face shelf in an easy and secure manner. Particularly, it is an object of the present invention to provide a novel label holder for a shelf having a flat sloping front edge or face with an inwardly oriented lip disposed parallel to the horizontally-oriented merchandise support surface.

Still further, it is an object of the present invention to provide a novel label holder that is mounted to a sloping flat front face shelf free of any taped connections and easily mountable to the shelf.

It is further an object of the present invention to provide a label holder having a main or back body panel with a hingedly and resiliently secured cover member which defines a pocket to receive a label and wherein the cover member can be opened to insert or withdraw a label while maintaining the label holder firmly connected to the shelf. That is, the back surface of the main body panel is intended to remain forcibly and securely maintained in mating engagement to the flat face shelf even when the cover member is opened. Thus, it is an object of the present invention to provide a label holder where the back or main body panel is firmly and forceably engaged with the shelf face to keep it from moving when the window is opened.

Still further, it is an object of the present invention to provide a plurality of elongated flexible bumps or ridges on the rear surface of the main body panel to engage the shelf face to prevent the label holder from slipping downward when the window is opened or when the label holder is hit with a downward motion and to also reduce pressure on that part of the label holder that is mounted to the inwardly directed shelf lip.

Still further, it is an object of the present invention to provide a label holder for a standard shelf with the label holder including an upper section having a label holder and a lower section of a V-shape and U-shape being elastically stretched for frictionally engaging a lowermost portion of the standard shelf under a tension force.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The drawings serve to illustrate the present invention, but are not intended to be drawn to scale.

DESCRIPTION OF THE PREFERRED EMBODIMENTS

Figure 1:
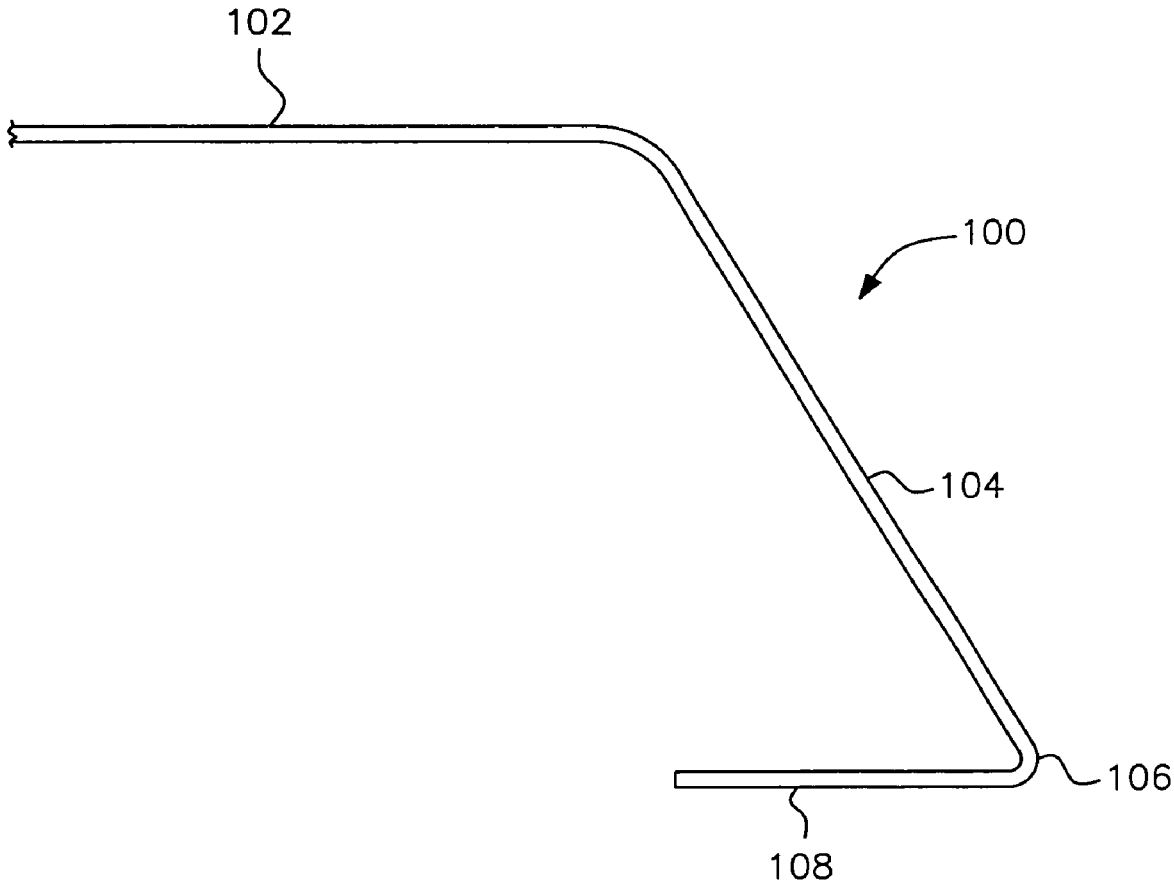
FIG. 1 is a side view or cross-sectional view of a standard shelf profile (mid-deck) to which the label holders of the present invention are intended to be attached.

Although only preferred embodiments of the invention are explained in detail, it is to be understood that the embodiments are given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

In the accompanying drawings, FIGS. 1-11, the label holder 10 (110, 310, 410) of the present invention is intended to be utilized with elongated standard shelving of the type shown in FIG. 1 as shelving 100. This "standard shelf", or "mid-deck" shelf, as the term is used herein, is typically mounted in stacked parallel planes above a bottom shelf or base deck of the type as is shown in FIG. 4A. As will be described, the bottom shelf or base deck configuration requires that the label holders in the various embodiments be dimensioned to fit over the bottom lip 208 and below the horizontal plate 205, i.e., within the gap therebetween.

The standard type of shelving includes a horizontally-oriented merchandise support surface 102 having a specific depth to retain merchandise thereon with an integrally-formed front edge or face 104 that is flat and typically disposed at an oblique angle with respect to the upper support surface 102. The shelf front face 104 may be of various heights typically approximately 13 to 12 inches. At the bottommost edge 106 of the shelf and integral therewith, is a return lip 108 that lies substantially parallel to the support surface 102 and is inwardly directed.

As is depicted in FIG. 1, the front edge or front face 104 forms an acute angle with the lip 108. Typically, the angle may approximate 60°. The depth of lip 108 may be of different dimensions particularly as will be indicated with respect to FIGS. 6 through 8.

The shelving is typically of metal and lies in overlying parallel relationship to adjacent shelves. That is, shelf 100 is part of a vertically-oriented stack of shelves conveniently separated from the adjacent shelf to enable merchandise to be stacked and supported on the support surface 102. As is depicted, the front shelf face 104 is free of any interconnecting elements that would enable a label holder to be secured thereto.

The novel label holder 10 comprises a back or main body panel 12 and a transparent cover member 14 which is of a similar profile, but spaced from the front face 16 of the main body panel 12. Such a label holder defines a pocket between the back panel 12 and cover member 14 to form a pocket which, when opened, will enable insertion or removal of a label and, when closed as in the position shown in FIG. 2, will retain the label within the pocket.

As is known in the art, the label holder 10 is typically elongated and extends a substantial length, such as up to four feet or more in length depending upon the size of the shelving. However, lengths less than the full length of the shelving can be utilized and, indeed, the length of the label holder may be as small as two inches to retain small individual labels to the shelf 100. The label holder is typically an extruded rigid PVC material. Preferably, the main body panel 12 is of a darkened color and the cover member 14 is transparent. Alternatively, the main body panel can also be transparent.

The cover member 14 is preferably thinner than the main body panel member 12 and is thus more flexible to enable it to be opened for insertion or removal of a label. When open, the label holder will generally flex about the hinged bottom area 18 or at least in an area toward the hinged bottom 18. By way of example, and not by limitation, the thickness of the cover member 14, from its respective front to rear faces may be 0.015 to 0.025 inches, whereas the thickness of the main body panel 12 from front to rear faces may be 0.045 to 0.055 inches.

The main body panel 12 of the label holder 10 includes an integral overhang 20 at its upper end to overlie the opening between the cover member 14 and the main body panel 12. This will provide protection from spillage of liquids, for example, when the label holder 10 is attached to the shelf 100. Although not shown, the main body panel 12 and cover member 14 could interlock through various locking arrangements that are known in the art and may be disclosed in the patents referred to above. Similarly, although not shown, the cover member 14 could include attachment mechanisms for attaching signs to thus form a combined label and sign holder as is also known in the art.

The main or back panel 12 is substantially linear and forms an acute angle with a bottom 40 that is integral therewith. Generally, the back panel 12 forms an acute angle with the bottom leg 40 of the label holder 10 substantially identical to the angle formed between the front face 104 and bottom lip 108 of the shelf to which the label holder is intended to be applied. The identical angles are not critical, however, and the acute angle between back panel 12 and bottom 40 can be less than the angle between front face 104 and bottom lip 108, in which case there will be a force exerted between the back panel 12 and the front face 104.

The bottom leg 40 is integrally formed with the back plate or member 12 and extends in a substantially horizontal direction and terminates in a U-shaped turn 42 with an upper plate-like leg member 44 which terminates in a radially-profiled free end 46. The spacing between the legs 44 and 40 of the U-shaped bottom member are closely spaced and, as will be described, are intended to engage and grip the lip 108 of the shelf. Disposed within the slot defined by the legs 40 and 44 is a plurality of flexible teeth or ridges 70, preferably seven, although the exact number could vary, that are preferably fully elongated and coextensive with the overall length of the label holder 10.

Figure 3:
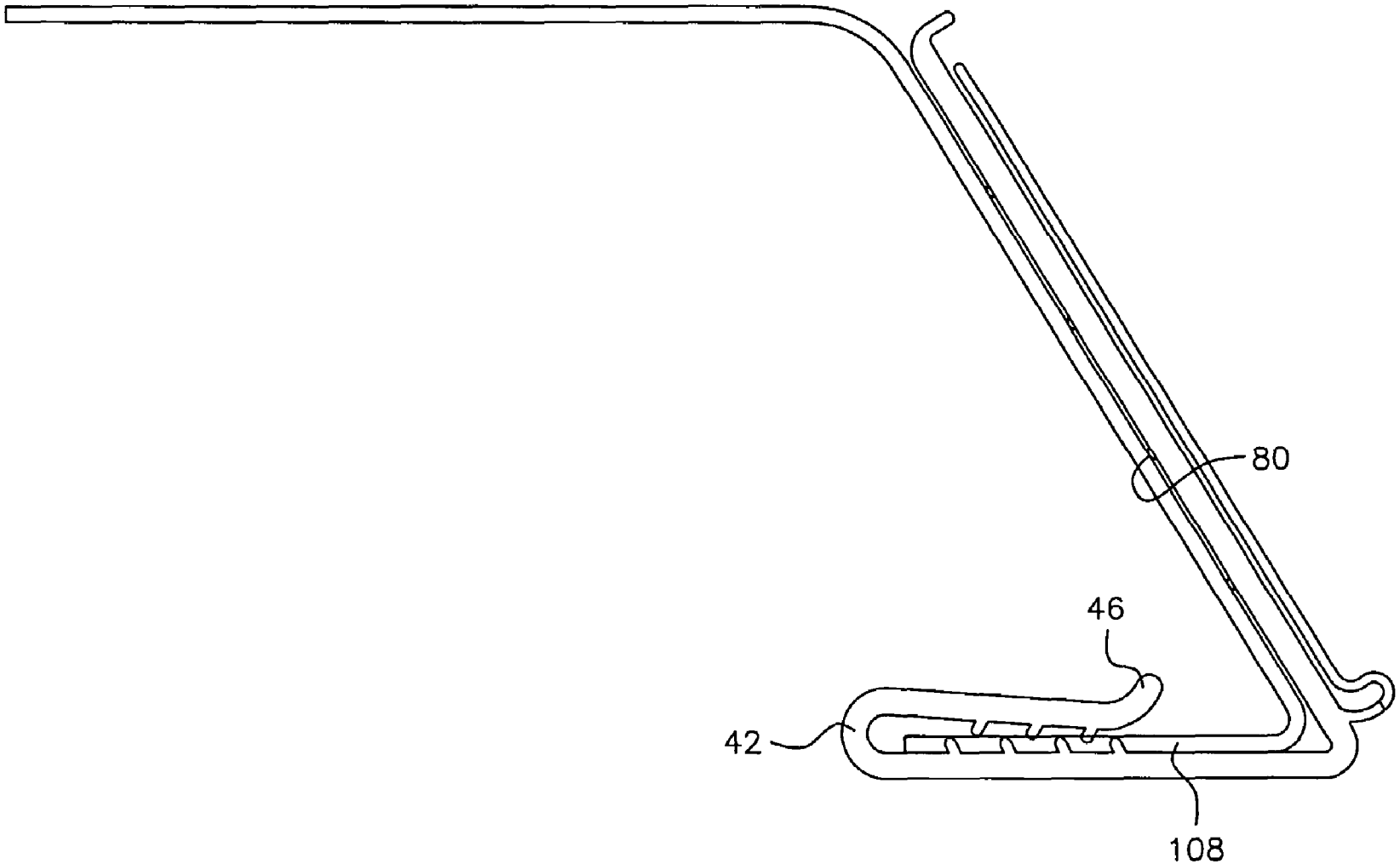
FIG. 3 is a side view or cross-sectional view of the label holder of FIG. 2 attached with the standard shelf of FIG. 1.
Figure 4A:
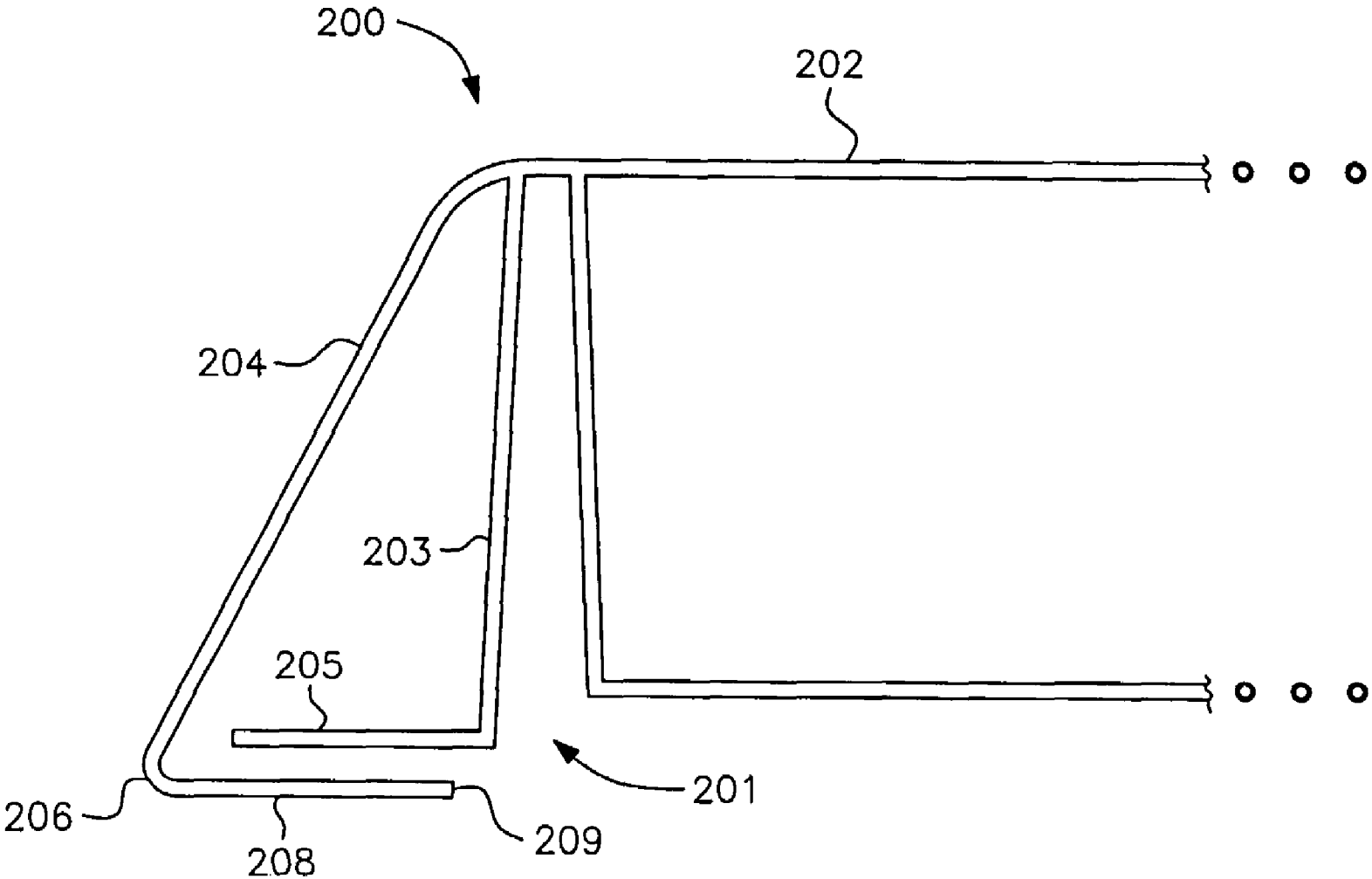
FIG. 4A is a side view or cross-sectional view of a bottom shelf or a base deck to which a label holder is intended to be attached.
Figure 11:
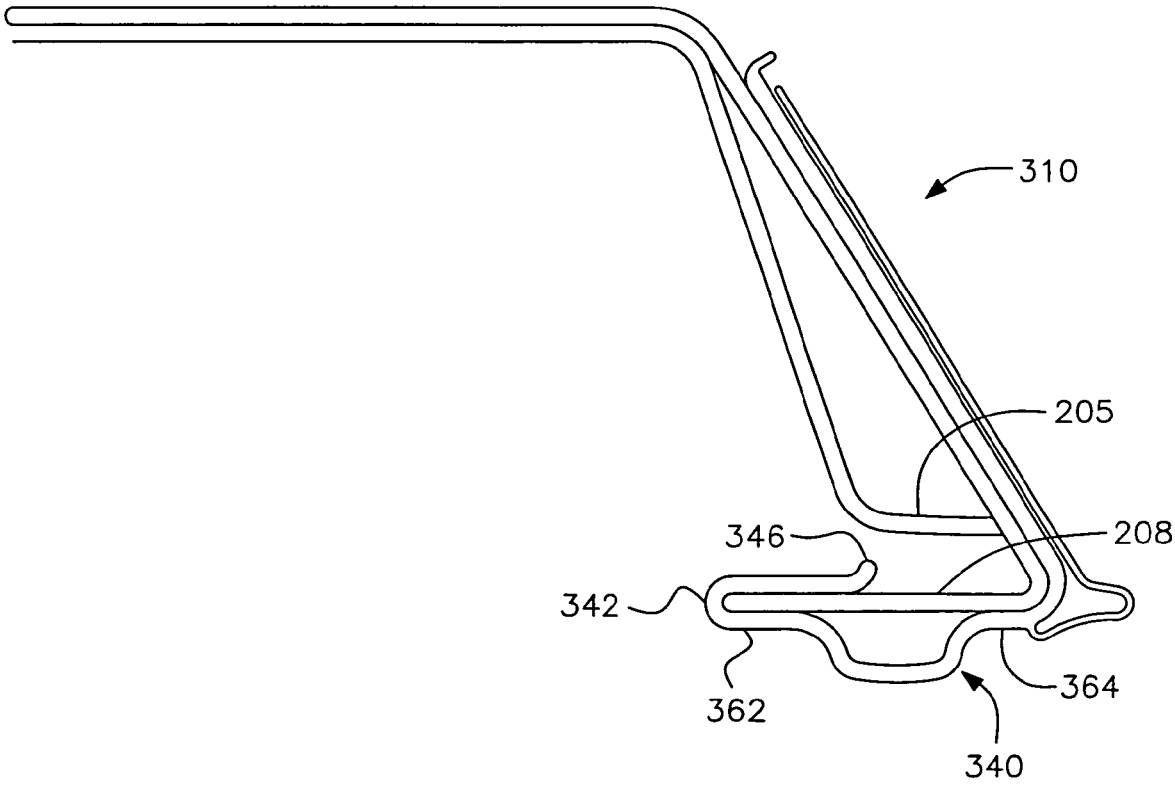
FIG. 11 is a side view or cross-sectional view of the label holder of FIG. 9 mounted on a bottom shelf or base deck.

FIG. 4A depicts a cross-sectional or end view of a bottom shelf or base deck. The base deck, as shown in FIG. 4A, is identified by the 200 series of numerals corresponding to the 100 series of FIG. 1. That is, the base deck 200 includes a horizontally-oriented merchandise support surface 202, a front edge or face 204, and a bottom lip 208. However, the base deck or bottom shelf includes a welded support brace in the form of an L-shaped bracket 201 defined by a generally-vertical oriented plate 203 (or may be slightly angled toward the front face as shown in FIG. 11), and a horizontally-oriented plate 205 that defines the L-shape of the brace. The plate 205 lies in relatively close relationship to the bottom lip 208. Accordingly, because the gap or spacing between the horizontal plate 205 and the bottom lip 208 is relatively narrow, a U-shaped mounting element of the type shown in FIGS. 2 and 3 may not be able to be easily mounted to the lip 208, unless the distance between the free end 46 and leg 44 is narrow enough to fit within the gap. See, FIG. 11, for example. A variation of the label holder for base deck bottom shelving of the type shown in FIG. 4B may be utilized to avoid the upturned free end 46.

Figure 2:
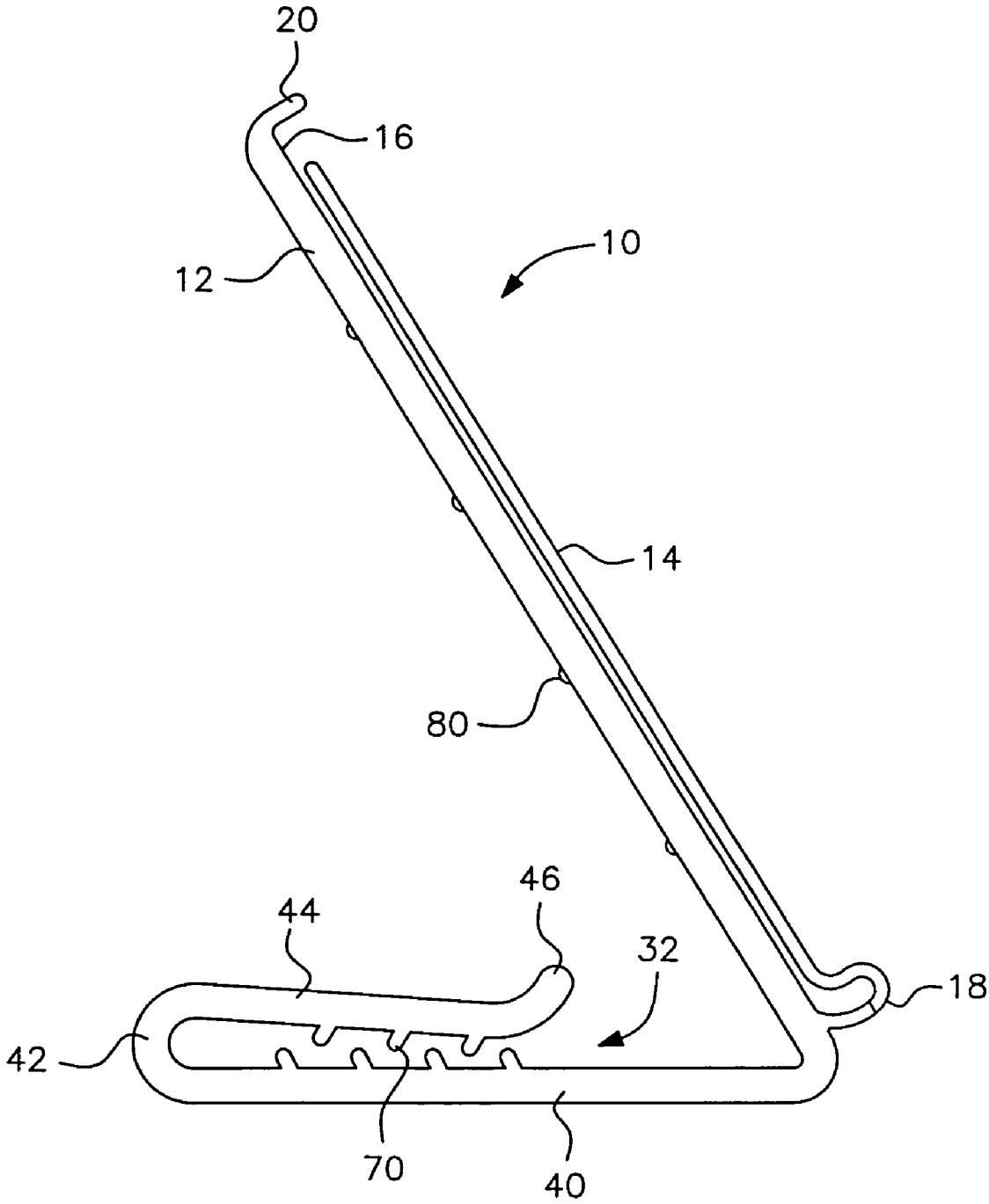
FIG. 2 is a side view or cross-sectional view of one embodiment of a label holder for a standard shelf of the present invention.
Figure 4B:
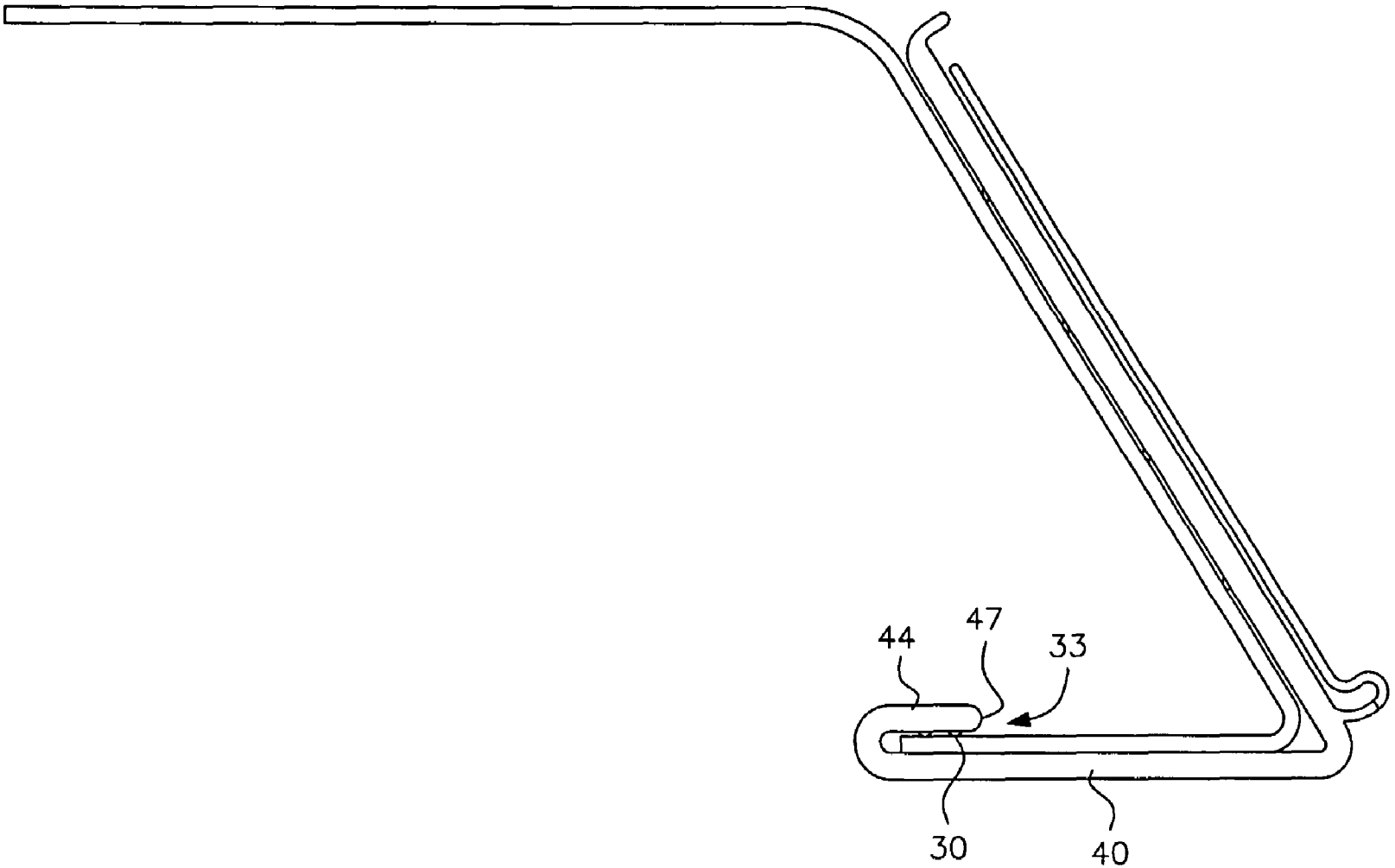
FIG. 4B is a side view or cross-sectional view of a second embodiment of a label holder attached to the standard shelf of FIG. 1, it being understood as being within the scope of the present invention that the embodiment of FIG. 4B may be used in combination with a base shelf as is typically found in a series of stacked shelves, as well as a mid-deck or standard shelf of the type shown in FIG. 1.

As shown in the second embodiment, FIG. 4B, a plurality of flexible ridges 30, extend from the leg 44 into the gap 32 between legs 40 and 44. Although two ridges 30 are shown, it is understood as being within the scope of the present invention that other numbers of ridges may be included depending upon the depth of leg 40. The reduced width of leg 44 as shown in FIG. 4B, as compared to the width of leg 44 as shown in FIG. 2, enables the label holder of FIG. 4B to be used in conjunction with a standard sized shelf as well as with a base shelf 200 of a series of shelves that includes a reduced sized space available for insertion of leg 44 of FIG. 4B. In FIG. 4B, free end 47 is closer to bottom leg 40 as compared to radially-profiled free end 46 in FIG. 2 to reduce the size of gap 33 in FIG. 4B as compared to gap 32 in FIG. 2.

Flexible ridges 30 or teeth 70 are of flexible PVC in contrast to the relatively rigid PVC of the remaining portions of the label holder. Typically, these flexible teeth or ridges have a height of approximately 0.020 inches, whereas the overall spacing between the inner surfaces of the slots or gaps 32, 33 defined by the legs 40 and 44 is 0.032 inches. That is, the teeth 70 will overlap each other slightly which will enable a tight grip of the label holder on the bottom lip 108 of the shelf. With respect to the ridges 30 projecting only from the leg 44 in FIG. 4B, a force is created by the engagement of lip 108 and the ridges 30 to maintain the position of lip 108 in slot or gap 33.

A plurality of ridges 80 of similar material to the teeth 70 and ridges 30 is integrally formed with the rear surface of the back panel 12. These ridges are spaced along a height of back panel 12 and are also of flexible PVC and of a similar dimension, preferably, to the ridges 30, although the dimensions may vary. Although the preferred number of four ridges 80 is shown, the number of ridges 80 may vary.

The mounting of the label holder 10 to the shelving 100 is shown in FIGS. 3 and 4B. The label holder is mounted by slipping the bottom legs 40, 44 onto the free edge of the lip 108 and then rotating the window portion of the label holder defined by back member 12 and cover member 14 around to the front of the shelf for engagement with the face 104. The bottom legs 40, 44 are mounted by preferably holding the label holding portions 12, 14 generally horizontally below the lip 108 so that the slots or gaps 32, 33 are relatively vertical and the free ends 46, 47 are pressed against the top of lip 108 and then the holder is rotated. The flexible ridges 30 and teeth 70 within the slots or gaps 32, 33 defined by the legs 40 and 44 serve to hold the label holder firmly to the shelf and keep it in position.

When attached, as shown in FIGS. 3 and 4B, the back panel 12 will exert force upon the front face 104 of the shelf due to the angle between the back member 12 and leg 40 as compared to the angle between the front face 104 and lip 108. A force of engagement between the back panel 12 and front face 104 is also increased by the resilience of the ridges 80. The force or pressure exerted between the label holder and the front face 104 presses the top of the label holder firmly against the front face of the shelf to keep the label holder from moving when the window or cover member 14 is opened by flexure in a counterclockwise direction. In addition, the back panel 12 is thicker and thus more rigid than the cover member or window 14 and this further assists to keep the back panel against the front of the shelf when the window is open.

Significantly, the ridges 80 of flexible PVC at the rear of the back panel 12 assist in preventing undesirable downward slippage or movement of the label holder. That is, the flexible ridges 80 act to prevent or limit downward movement of the label holder 10 if the label holder is hit with a downward motion or if the window or cover 14 is opened and a downward pressure is exerted when changing labels. Such window opening has a tendency to otherwise move the label holder downward. However, the flexible ridges provide friction against the front face of the shelf 104 to counteract the downward movement.

The flexible ridges 80 also reduce the pressure on the rear mounting portion defined by legs 40, 44. Also, the flexible ridges 80 serve as a shock absorber when the shelf is hit by a horizontally oriented force component, such as being hit by a shopping cart, floor scrubber, etc. This also protects the extruded label holder from cracking or breaking.

The U-shaped mounting element defined by legs 40, 44 is typically longer than the lip 108 dimension so that there is free space between the end of the lip 108 and the U-shaped turn 42. This enables accommodation of the label holder with different size lips.

The front label retaining portion defined by back plate 12 and window 14, is usable with other types of mounting elements other than the U-shaped mounting element defined by legs 40, 44. For example, other forms of attachment could be utilized with the back member 12 and cover member 14 to attach the label holder with a lip 108 of the shelf. See, for example, the attachment mechanism shown in U.S. Design Pat. No. D480,434.

Because of the different sizes of bottom lip 108 between various sets of shelving it is possible that there would be space or depth limitations present which would prevent the use of a label holder 10 having a relatively long U-shaped element as defined by the plate-like legs 40,44 from fitting on the bottom lip 108. To accommodate different sized lips 80, an expandable bottom portion 90 or attachment structure of a label holder 110 (310, 410) would be used as is shown in the embodiment of FIGS. 5 through 8 and the embodiment of FIGS. 9 through 11. Such embodiments provide for elastic stretching to enable the label holder to be tautly gripped to the bottom lip of the shelf.

Figure 5:
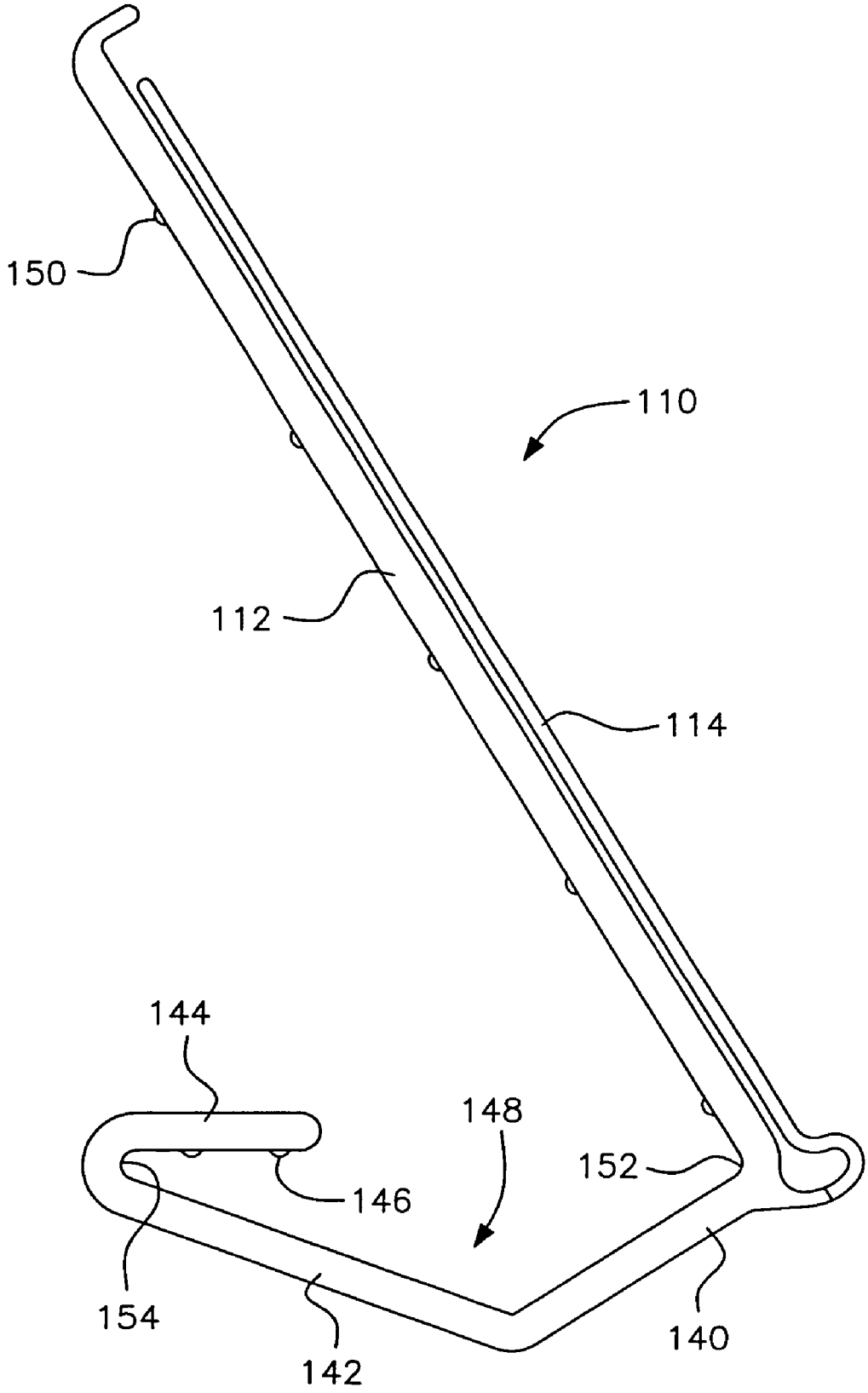
FIG. 5 is a side view or cross-sectional view of a third embodiment of a label holder of the present invention, it being understood as being within the scope of the present invention that the embodiment of FIGS. 5 through 8 may be used in combination with a base shelf as is typically found in a series of stacked shelves.

A label holder 110 for accommodating different sizes of bottom lip 108 is shown in FIG. 5. There, the label holder 110 includes a window member 114 and back member 112 similar to the embodiment of FIGS. 2 and 4B, and includes a V-shaped mounting leg member or attachment structure defined by lower leg portions 140, 142 and upper leg 144. Significantly, the upper leg 144 is much shorter than the combined corresponding leg portions 142, 144. Flexible ridges 146 are shown extending within the interior of the opening 148 defined between the upper leg 144 and leg portion 142, but these are not required.

The label holder 110 also includes five flexible PVC plastic ridges 150 integrally extruded at spaced intervals on the rear of the back plate 112, but positioned similarly to the ridges 80 in the previously described embodiments. The number of ridges 150 may vary within the scope of the present invention. The ridges 150, however, may be eliminated.

To accommodate different widths of bottom lip 108, the label holder 110 as shown in FIG. 5, includes a dimensioning between the connection 152 between the rear plate 112 and leg 140 and the connection 154 between the leg 146 and leg 142 which is less than the minimum depth of bottom lip 108. For example, in the embodiment in FIG. 5, the extension between connections 152 and 154 may be 0.500 inches and an angle between leg portions 142, 144 would be approximately 130°.

Figure 6:
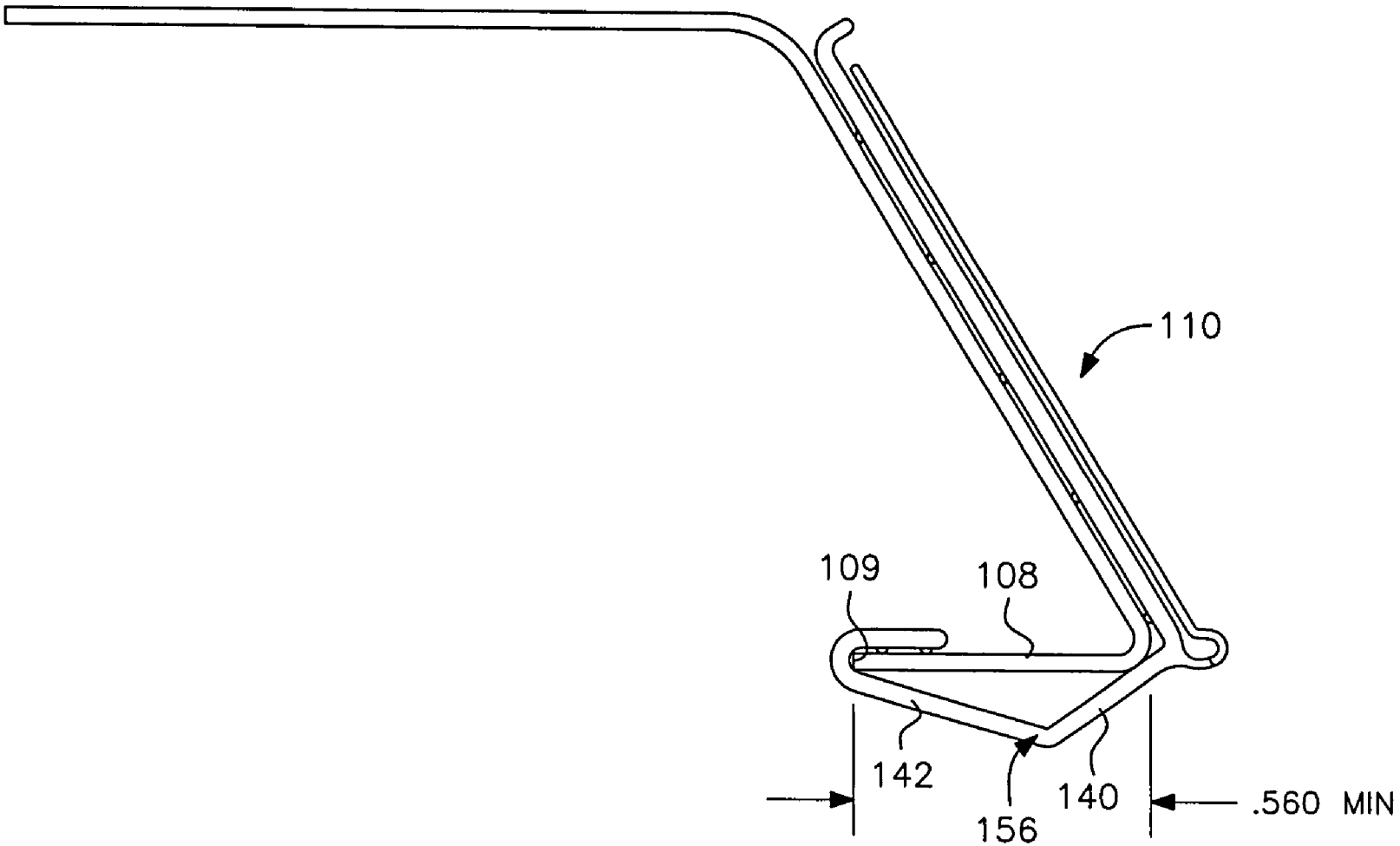
FIG. 6 is a side view or cross-sectional view of the label holder of FIG. 5 attached to a return lip of the standard shelf of FIG. 1 or a base shelf having a widthwise dimension of 0.560 inches.

When the label holder 110 is mounted on bottom lip 108 as shown in FIG. 6, the depth of bottom lip 108 would be 0.560 inches. Due to a lesser extension between the connections 152, 154, when the label holder 110 is mounted on the bottom lip 108 as shown in FIG. 6, the V-shaped connection 156 between legs 142 and 140 would be stretched to an angle of approximately 135° to increase the separation between connections 152, 154 and thereby accommodate lip 108. The stretching is preferably elastic, i.e., the angle will revert to its original shape when removed from the shelf.

Figure 7:
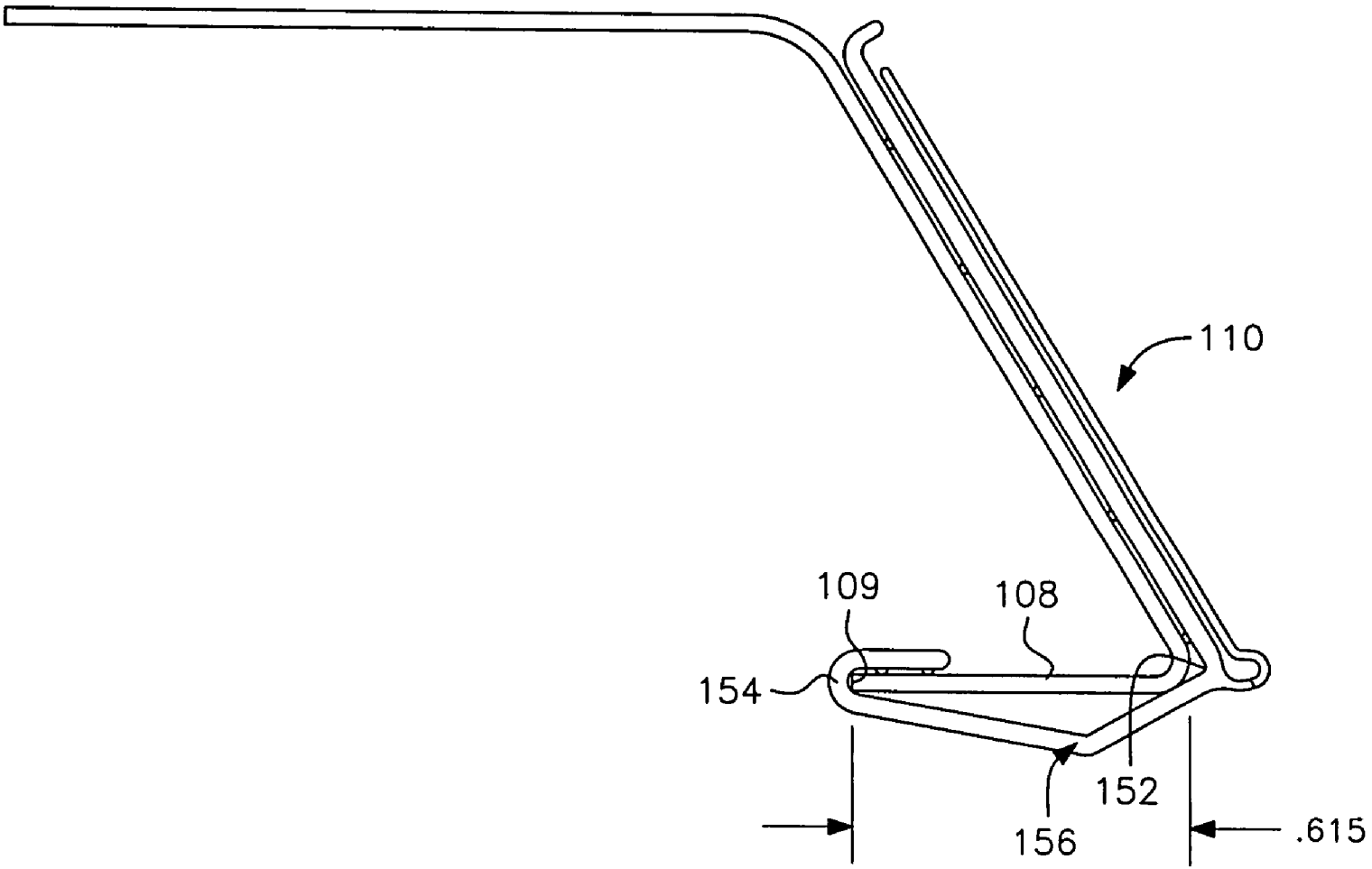
FIG. 7 is a side view or cross-sectional view of the label holder of FIG. 5 attached to a return lip of the standard shelf of FIG. 1 or a base shelf having a widthwise dimension of 0.615 inches.
Figure 8:
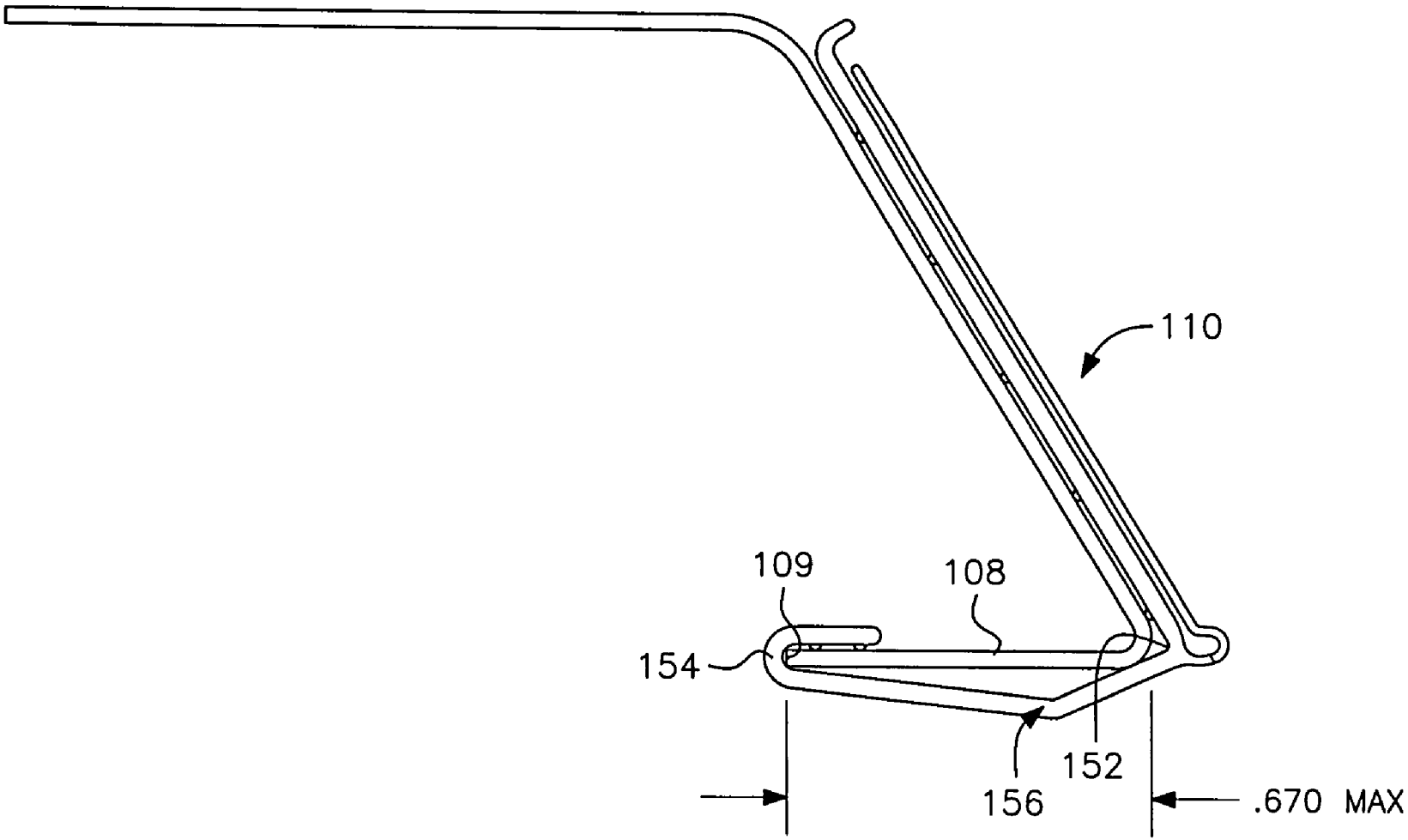
FIG. 8 is a side view or cross-sectional view of the label holder of FIG. 5 attached to a return lip of the standard shelf of FIG. 1 or a base shelf having a widthwise dimension of 0.670 inches.

As further shown in FIG. 7 and 8, where the depth of bottom lip 108 is 0.615 and 0.670 inches, respectively, the amount of stretch at intersection 156 is increased to accommodate the increased depth of the bottom lip 108. V-shaped connection 156 would be stretched to an angle of approximately 145° and 150°, respectively. Thereby, different depths of bottom lip 108 may be provided for by a single label holder 110.

The label holder 110 is applied to the lip 108 in a manner similar to the application of the label holder 10 to the lip 108. That is, the upper leg 144 is pressed against the top portion of the lip 108 and the shelf is then pulled or rotated to overlie the front edge 104 of the shelf. Because of the shape of the leg 144, it can fit around a bottom lip of standard shelves as well as base shelves. That is, the U-shaped connection 54 is "pulled" against the free edge 109 of the lip 108. FIGS. 6, 7 and 8 depict the mounting position of the label holder 110 on the bottom lip 108. Note that the back of the U-shaped connection 154 abuts against the edge 109 of the lip 108 and is pulled against it by the forces exerted by the V-shape expansion of the angle between legs 140, 142.

Figure 9:
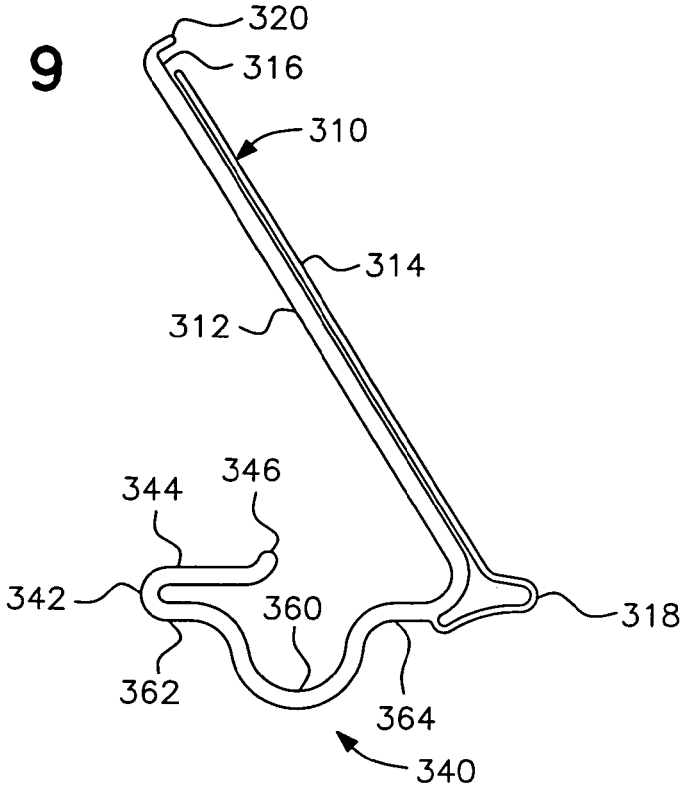
FIG. 9 is a side view or cross-sectional view of a fourth embodiment of a label holder of the present invention having a U-shape lower section with a top opening window.

Another label holder for accommodating different sizes of bottom lip 108 is shown in FIGS. 9 and 11. This embodiment is similar to the embodiment of FIGS. 5 through 8, but includes instead a U-shaped member 340, instead of the V-shaped member of the embodiment of FIGS. 5 through 8. Specifically, the label holder 310 includes a front window 314, a back plate 312, interconnected by a hinged bottom member 318. A label is shown between the window 314 and the main body panel 312. Extending in a rearward direction from the back panel 312, is an attachment structure or bottom leg 340, including a first generally linear front portion 364 merging into a radially, downwardly concave portion 360, and extending further rearward to a generally linear rear section 362. Section 362 terminates at a free end 342 and has a U-shaped return 344 defined by an upper plate-like member 344 which, in the embodiment shown, terminates in a radially-profiled free end 346. The upward height of the free end 346 is limited to enable it to be applied to a base deck as shown in FIG. 11. Of course, the upturned radially-profiled free end 346 could be eliminated entirely, similar to the embodiment of FIGS. 5 through 8. The attachment structure 340 fits onto the lip 108 or lip 208 of the standard or base member and is "stretched" to provide a spring-like taut connection to the bottom lip 108, 208. As with the embodiment of FIGS. 5 through 8, the U-shaped lower leg portion can be applied to the different widths as shown in FIGS. 6, 7 and 8, and indeed other widths of comparable dimensions.

In the embodiment of FIGS. 9 and 11, the back panel 312 is designed to parallel the front face 104, 204 of the shelf of FIGS. 1 and 4A. That is, the acute angle of the back panel 312 with an imaginary line drawn between the rearward free end of the turn 342 to where the leg 340 front section 369 joins the back panel 312 is substantially equal to the angle formed between the front face 104, 204 and bottom lip 108, 208. The label holder is intended to be retained to the shelf 100 by forces acting between the attachment structure 340 and the lip 108, 208. The spring-like elastic deformation between the lower leg 340 and the bottom lip 108 or 208 provides a gripping or retaining mechanism to hold the label holder to the shelf. No force need be exerted between the back panel 312 and the front face 104, 204 of the shelf to retain the label holder to the shelf. Thus, as the bottom leg 340 is tautly placed around the bottom lip 108, 208, the radius of the U-shaped portion 460 of the bottom leg 440 is displaceable laterally, i.e., the radius of curvature increases to provide the taut gripping force.

The embodiment of FIGS. 9 and 11 has the window 314 in a top opening configuration. This is similar to the above-described embodiments. The window can be opened by exerting finger pressure on the portion 318 which will separate the window 314 from the back panel 312 to enable the labels to be inserted and removed.

Figure 10:
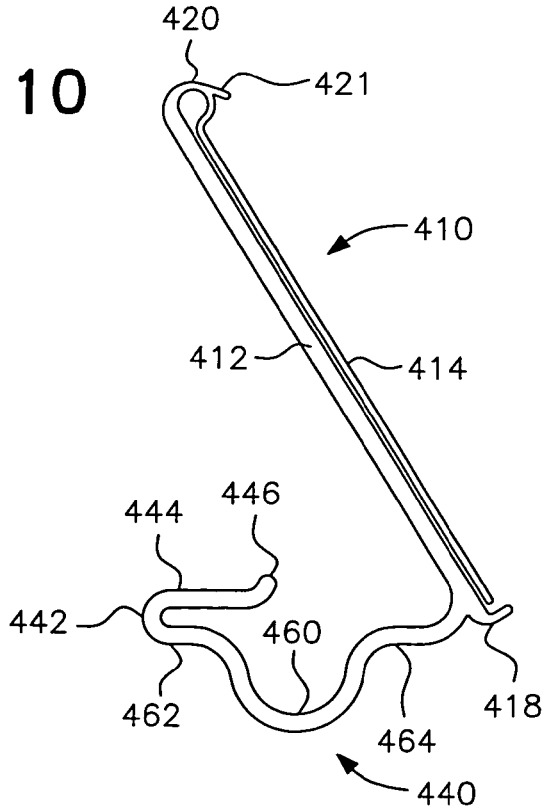
FIG. 10 is a side view or cross-sectional view of a fifth embodiment of the present invention having a U-shape lower section with a bottom opening window.

FIG. 10 discloses a similar embodiment to that of FIGS. 9 and 11, but where the front panel 414 is open at the bottom. Comparable numerals are provided, but prefaced by the numeral 400. In this embodiment, the front panel 414 is opened by exerting pressure on an extension of the top area 421 where the front panel joins with the back panel, such pressure causing the front panel 414 to angle upwardly relative to the back panel. Otherwise, the embodiment of FIG. 10 is identical of that of FIGS. 9 and 11.

The embodiments of FIGS. 9-11 are devoid of flexible ridges on the back panel as is shown in the embodiment of FIGS. 5-8. It should be apparent that such ridges could be utilized. Similarly, the embodiment of FIGS. 5-8 can be devoid of ridges. Both embodiments may have an upturned free end or may be perfectly straight as is shown in the embodiment of FIGS. 5 through 8.

The foregoing descriptions and drawings should be considered as illustrative only of the principles of the invention. Numerous applications of the present invention will readily present themselves to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. A merchandise display apparatus comprising:

a shelf comprising a horizontally-oriented merchandise support surface, a front face extending downwardly therefrom and a planar bottom lip substantially parallel to the support surface, directed rearwardly, and having a free bottom lip edge;

a label holder for carrying and displaying merchandise labels comprising a back panel and a transparent cover member, said back panel and cover member being resiliently interconnected to define a pocket therebetween for carrying a label, and an attachment structure for attaching the label holder to said planar bottom lip of the merchandise shelf, said attachment structure including a bottom leg integrally connected with said back panel and extending rearwardly therefrom to define a generally acute angle with said back panel, said bottom leg including a front portion integrally-coupled with said back panel, a rear portion having a free end, an upturned section extending from the free end for receiving said free bottom lip edge of said shelf, and an intermediate portion located between said front portion that is coupled to said back panel and said free end, said intermediate portion of generally concave configuration, said bottom leg having a width from the back panel to the free end less than the width of said planar bottom lip before attachment, said bottom leg elastically stretchable at its concave intermediate portion to tightly grip the bottom lip and retain the label holder thereto.

2. The label holder of claim 1, wherein said concave portion is U-shaped.

3. The label holder of claim 1, wherein said concave portion is V-shaped.

4. The label holder of claim 1, wherein the cover member and back panel are resiliently interconnected at their top edges.

5. The label holder of claim 1, wherein said cover member and back panel are resiliently interconnected at their bottom edges.

6. The label holder of claim 1, wherein said concave portion is defined by a substantially circular arc between said front section and rear section and is deformable such that the radius of curvature of said arc increases when attached to said bottom lip.

* * * * *